US010670052B2

(12) United States Patent
Klingen et al.

(10) Patent No.: US 10,670,052 B2
(45) Date of Patent: Jun. 2, 2020

(54) SYNCHRONIZING CYLINDER FOR EXTRUDER

(71) Applicant: SMS GROUP GMBH, Düsseldorf (DE)

(72) Inventors: Hermann-Josef Klingen, Moers (DE); Uwe Muschalik, Duisburg (DE); Ekhard Siemer, Veitshoechheim (DE); Karl Herrmann Claasen, Moers (DE); Valentin Gala Losada, Moenchengladbach (DE); Andreas Wershofen-Crombach, Moenchengladbach (DE)

(73) Assignee: SMS GROUP GMBH, Duesseldorf (DE)

( * ) Notice: Subject to any disclaimer, the term of this patent is extended or adjusted under 35 U.S.C. 154(b) by 23 days.

(21) Appl. No.: 16/066,701

(22) PCT Filed: Feb. 1, 2017

(86) PCT No.: PCT/EP2017/052135
§ 371 (c)(1),
(2) Date: Jun. 28, 2018

(87) PCT Pub. No.: WO2017/140499
PCT Pub. Date: Aug. 24, 2017

(65) Prior Publication Data

US 2019/0017522 A1 Jan. 17, 2019

(30) Foreign Application Priority Data

Feb. 16, 2016 (DE) ..... 10-2016-202-357
Aug. 9, 2016 (DE) ..... 10-2016-214-767

(51) Int. Cl.
*F15B 13/02* (2006.01)
*F15B 15/14* (2006.01)
(Continued)

(52) U.S. Cl.
CPC ..... *F15B 13/021* (2013.01); *F15B 11/22* (2013.01); *F15B 15/149* (2013.01);
(Continued)

(58) Field of Classification Search
CPC .. F15B 13/021; F15B 15/1428; F15B 15/149; F15B 2211/7054; B21C 23/211; B30B 1/32
See application file for complete search history.

(56) References Cited

U.S. PATENT DOCUMENTS 4,876,906 A 10/1989 Jones
5,699,714 A * 12/1997 Jung ..... F15B 13/01 60/468
(Continued)

FOREIGN PATENT DOCUMENTS

DE 920709 B 11/1954
DE 3801684 A 7/1989
(Continued)

*Primary Examiner* — Thomas E Lazo
(74) *Attorney, Agent, or Firm* — Andrew Wilford

(57) ABSTRACT

A double-rod ram (1), preferably for an extruder, comprising an outer cylinder (10), an inner cylinder (20) installed therein and arranged concentrically therewith, a double-acting work piston (41) provided in the inner cylinder to be displaceable and a bypass device (50) with at least one bypass valve (52), wherein the work piston (41) divides the inner cylinder (20) into two compartments (42) and can be loaded with a hydraulic fluid from both compartments (42), wherein the bypass device (50) is so arranged that in a bypass position of the bypass valve (52) a fluid connection between the two compartments (42) is formed by a direct connection, preferably at least one bypass line, and in a work position of the bypass valve (52) no such fluid connection is present.

11 Claims, 3 Drawing Sheets

(51) Int. Cl.
*F15B 15/20* (2006.01)
*F15B 11/22* (2006.01)

(52) U.S. Cl.
CPC ..... *F15B 15/1428* (2013.01); *F15B 15/202* (2013.01); *F15B 2211/7054* (2013.01)

(56) References Cited

U.S. PATENT DOCUMENTS

| | | | | |
|---|---|---|---|---|
| 5,727,444 | A | 3/1998 | Dietrich | |
| 6,058,826 | A * | 5/2000 | Dietrich | B62D 5/12 60/406 |
| 7,913,616 | B2 * | 3/2011 | Aoki | F15B 7/00 100/269.14 |
| 2015/0090132 | A1 * | 4/2015 | Poggenpohl | B21C 23/211 100/35 |
| 2015/0354604 | A1 | 12/2015 | Froehlich et al. | |
| 2018/0119817 | A1 * | 5/2018 | Landberg | F16J 3/046 |

FOREIGN PATENT DOCUMENTS

| | | | |
|---|---|---|---|
| DE | 3836702 | B | 9/1989 |
| DE | 19925600 | A | 12/2000 |
| EP | 2420681 | A | 2/2012 |
| JP | 016078 | C1 | 2/1979 |
| JP | 141898q | C1 | 6/1988 |
| JP | 5401678 | B2 | 11/2013 |

* cited by examiner

FIG.3
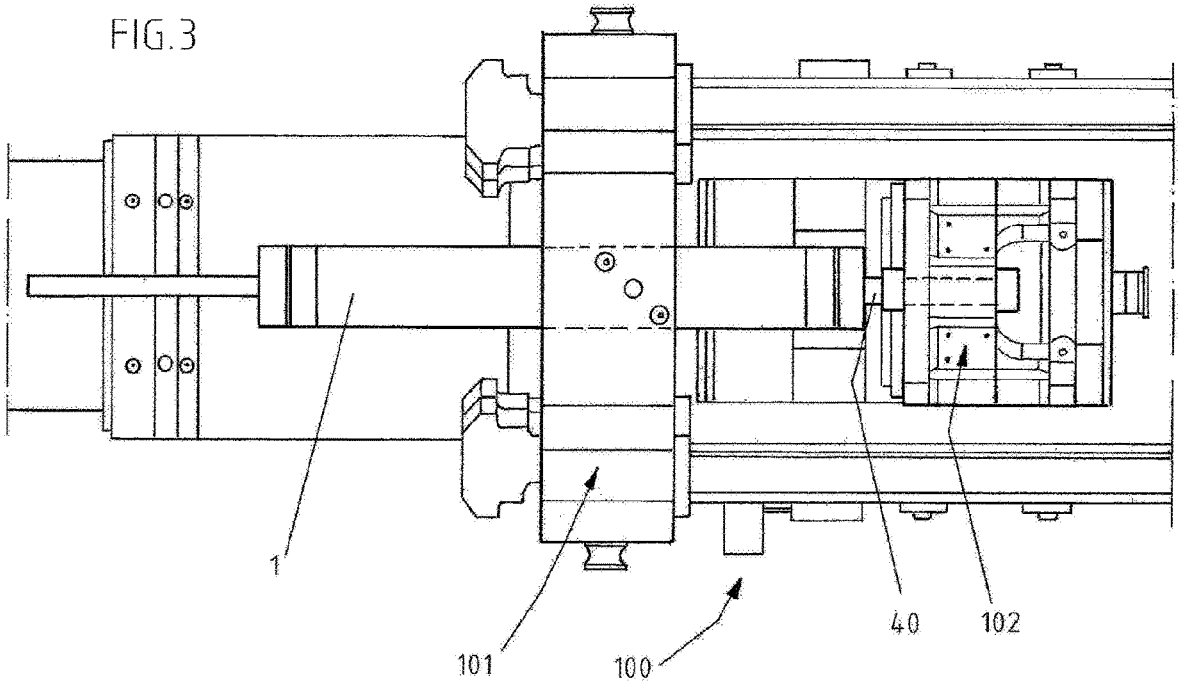
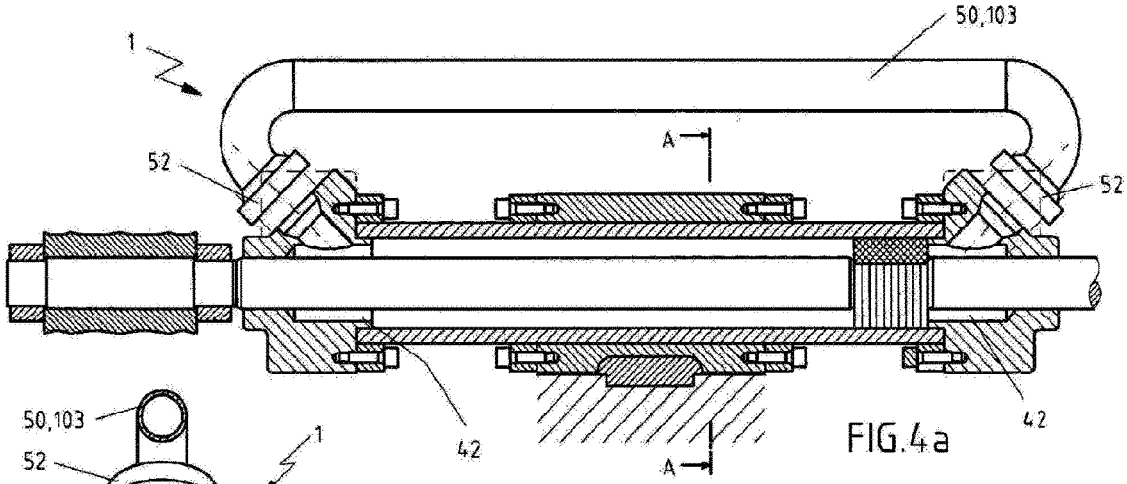
FIG.4a
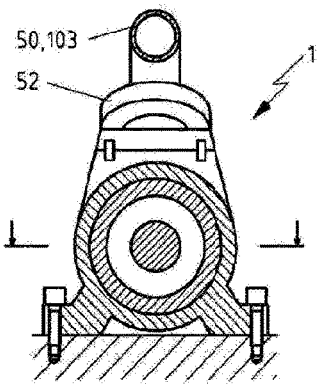
FIG.4b

SYNCHRONIZING CYLINDER FOR EXTRUDER

CROSS REFERENCE TO RELATED APPLICATIONS

This application is the US-national stage of PCT application PCT/EP2017/052135 filed 1 Feb. 2017 and claiming the priority of German patent application 102016202357.8 itself filed 16 Feb. 2016 and German patent application 102016214767.6 itself filed 9 Aug. 2016.

FIELD OF THE INVENTION

The invention relates to a double-rod ram, preferably for use in a shaping apparatus, particularly a press, extruder or ring roller.

BACKGROUND OF THE INVENTION

Extruders and ring rollers are devices for plastic shaping of materials, for example preheated heavy-metal or light-metal ingots, by a selective application of force. Thus, in the case of an extruder, for example, such a heavy-metal or light-metal ingot, also termed billet, is driven by a hydraulically operated press ram through a so-called die, whereby a semi-finished product with a specific defined profile is produced. Such extruders are evident from, for example, DE 38 36 702 C1 and DE 10 2012 009 182 A1 [US 2015/0090132].

Apart from the actual application of force for shaping the workpiece, plants of that kind typically have drives for moving or positioning the receiver with the die or other plant components. The ingot receiver is typically configured by hydraulic cylinders over large strokes and brought into position. Thus, for example, the receiver is moved in this way between a position for ingot change and a front end position, i.e. the work position, at which sealing or pressing against, ventilating and stripping take place. Alternatively, use is made of electric motors which move the receiver between the ingot change position and the work position.

In the case of use of electric motors, internal forces of the hydraulic cylinders have to be overcome. This applies particularly to the use of double-rod rams in which due to the mode of construction thereof, i.e. two guided piston rods plus pistons, in a given case hollow-cylinder pistons, it is necessary to overcome, apart from flow losses, relative mechanical friction forces. On the other hand, double-rod rams are useful in the discussed shaping apparatuses, since they can be converted over the entire stroke thereof from towed operation to work operation.

OBJECT OF THE INVENTION

An object of the invention consists of providing a double-rod ram which with a compact, long-life mode of construction is movable in a low-loss manner, efficiently and rapidly by an external drive, preferably an electric motor or a pneumatic motor or, however, a hydraulic cylinder or the like. A further object consists of indicating shaping equipment, preferably a press, extruder or ring roller, which with a compact long-life mode of construction realizes an efficient and rapid movement of the plant between a work configuration and one or more other configurations.

SUMMARY OF THE INVENTION

The double-rod ram according to the invention is a hydraulic cylinder having an outer cylinder and an inner cylinder mounted therein and arranged concentrically therewith. A displaceable double-acting work piston is mounted in the inner cylinder. In the case of double-acting hydraulic cylinders or work pistons there are two opposite piston surfaces acted on by hydraulic fluid. The hydraulic cylinder thereby has two active movement directions. For that purpose, the work piston divides the inner cylinder into two compartments and can be loaded with a hydraulic fluid from both compartments. If there is a pressure difference between the two compartments, a work force acts on the work piston. The work piston is in addition connected with a piston rod or constructed with such integrally or in one piece, wherein the piston rod preferably protrudes from both ends of the outer cylinder and is guided thereat, for example by cylinder closures mounted at the ends. An annular gap between the inner cylinder and the outer cylinder and/or another direct connection, for example in the form of one or more bypass lines, is or are present.

In addition, the double-rod ram comprises a bypass device with at least one, preferably two, bypass valves. The above-mentioned annular gap and/or the at least one bypass line is or are a component of the bypass device. The bypass device is so arranged that in a specific setting or position of the bypass valve, here termed bypass position, a fluid connection is formed between the two compartments via the annular gap and/or the at least one bypass line and in another setting or position of the bypass valve, here termed work position, no such fluid connection (within the double-rod ram) is formed. In other words, the bypass position allows a fluid exchange between the compartments in that hydraulic fluid flows from one compartment via the annular gap and/or the at least one bypass line to the other compartment, whereas such a fluid exchange is precluded in the work position. The described double-rod ram has a compact form of construction in which a circumventing function, also termed bypass function, is realized in a technically simple way. The annular duct formed by the concentric cylinders, i.e. inner cylinder and outer cylinder, allows a low-loss bypass flow. The same also applies, additionally to the annular duct or alternatively thereto, to the at least one bypass line outside the cylinder housing. The work piston can thus be moved by an external drive in energy-saving manner, with low loss and rapidly. By virtue of the synchronous mode of construction, the hydraulic cylinder can develop the full rated force in every stroke position.

Due to the above-described technical effects and advantages the double-rod ram is particularly advantageous in the field of shaping equipment, particularly presses, extruders or ring rollers. The extruders in that case have a lifted-out position, since a rapid movement of the receiver or in a given case other plant parts over a large stroke is desirable there. The double-rod ram according to the invention then combines, in synergetic manner, a work operation and a towed operation over the entire stroke. In particular, the double-rod ram can, over the entire stroke, be switched over between work operation and towed operation, thus the operation in which the bypass valve is brought into the bypass position and the double-rod ram is moved by an external drive, for example one or more electric motors. The flow losses and the internal friction of the double-rod ram are then reduced so that the towed operation can be carried out in force-saving manner, efficiently in terms of energy and rapidly.

The piston rod is preferably designed so that it extends on both sides from the work piston and has the same diameter on both sides. In this way the double-rod ram can be realized in a technically particularly simple manner, since in the case of a cylindrical work piston the contact surfaces for loading with the hydraulic fluid are of the same size on both sides. It is possible to dispense with a hollow-cylindrical piston, which is disadvantageous in terms of flow technology. In that regard, for preference the bypass valve is guided on the piston rod, preferably annularly surrounding the piston rod, and for switching over between the bypass position and a work position the bypass valve is in this case axially displaced. The piston rod is thus used synergetically as a guide and therefore, so to speak, as a component of the bypass valve. The technical construction of the double-rod ram is thereby simplified and susceptibility to fault reduced.

The bypass valve is preferably biased by a spring into the bypass position or the work position, with particular preference into the bypass position. In principle, the actuation of the bypass valve can be carried out in different ways, thus, for example, electrically, magnetically, hydraulically and/or mechanically. The bypass valve should, however, be activatable from outside. Due to the fact that the bypass valve is biased towards one side, construction is simplified because technically an active actuation has to be realized only in the other direction. With particular preference the bypass valve is securely fixable in the work position so that it is not unintentionally brought into the bypass position by, for example, the pressure in the compartment. According to a particularly preferred form of embodiment the spring for reposition or biasing the bypass valve is internally disposed, i.e. at least partly within the outer cylinder, preferably completely within the housing or completely within the double-rod ram closed off at the head by head sections.

The bypass valve is preferably hydraulically actuatable in order to create a durable technical solution non-susceptible to fault. With particular preference, the biasing by a spring and the hydraulic solution are combined. For the purpose of hydraulic actuation the bypass valve is disposed in contact with an actuating fluid which is supplied by an actuating line, in a given case with an actuating chamber, and a connection, which is suitable for that purpose, with the double-rod ram.

The bypass device preferably comprises two bypass valves provided at the opposite sides of the work piston. The bypass path can thereby be realized in technically simple manner by the annular gap and/or the at least one bypass line. In that case, with particular preference a substantially mirror-symmetrical construction of the bypass valve is used, in a given case of the entire double-rod ram, in order to homogenize the force characteristics. The bypass valve or bypass valves is or are preferably provided at the end regions or the head sides of the double-rod ram, whereby the stroke is maximized. The bypass valves can provide, together with the piston surfaces and the inner cylinder, a part of those walls which form the compartments.

The outer cylinder is preferably closed at each of its ends by a respective cylinder closure. The inner cylinder is preferably fixed at each of its ends relative to the outer cylinder by a cylinder head support. For that purpose the inner cylinder is preferably constructed to be shorter in axial direction than the outer cylinder. The terms "end side", "head side" and "end face" are used synonymously and mean the outer sections of the double-rod ram as seen in axial direction.

A hydraulic fluid connection with a hydraulic fluid line that penetrates the cylinder closure and/or the cylinder head support of the corresponding end side, is preferably provided. The hydraulic fluid line with the hydraulic fluid connection is disposed in fluid connection with the corresponding compartment and supplies this with hydraulic fluid.

The cylinder head supports can be components which not only contribute to creation and definition of the bypass device, preferably of the annular gap, but also can carry or include the hydraulic fluid lines. As a further function they can assist the technical construction of the bypass valves, because the bypass valves are preferably in contact not only with the piston rod, but also with the corresponding cylinder head support. The construction of the double-rod ram is thus substantially simplified and its susceptibility to fault reduced.

The two cylinder head supports preferably each have one or more bypass ducts forming a fluid connection between the compartments and the annular gap and/or the at least one bypass line. In that case, in the work position the bypass valves preferably close the fluid connection between the corresponding compartment and the corresponding bypass duct and open this fluid connection in the bypass position.

Although the invention is employed with particular preference in the technical field of extruders, the invention can also be realized in other areas, for example in the area of rolling mills or of general equipment for plastic deformation of hard workpieces such as, for example, metal ingots or sheets. Further advantages and features of the present invention are apparent from the following description of preferred embodiments. The features described there can be realized on a stand-alone basis or in combination with one or more of the above-mentioned features insofar as the features are not incompatible. The following description of the preferred embodiments in that case is made with reference to the accompanying drawing.

BRIEF DESCRIPTION OF THE DRAWING

FIG. 3 shows an installation position of a double-rod ram in the extruder.

FIG. 4 shows a further form of embodiment of the invention with an outer bypass line.

DETAILED DESCRIPTION OF PREFERRED EMBODIMENTS

Figure 1:
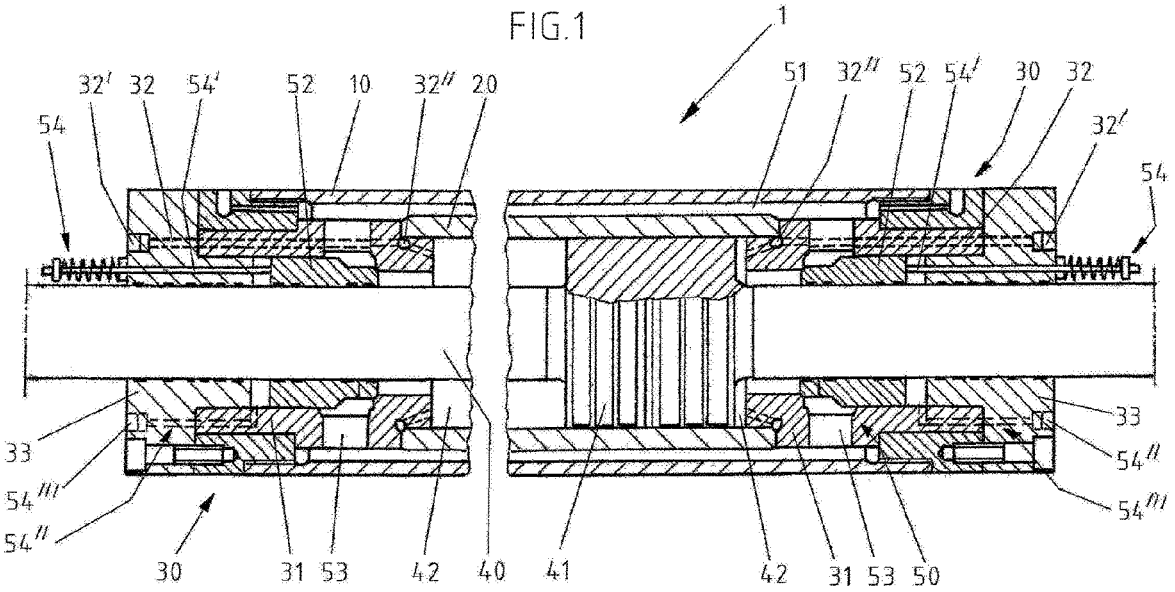
FIG. 1 is a longitudinal section of a double-rod ram in a first form of embodiment of the invention.

Preferred embodiments are described in the following on the basis of FIG. 1. In that case identical, similar or equivalent elements are provided with identical reference numerals and repeated description of these elements is partly dispensed with so as to avoid redundancies.

FIG. 1 shows a double-rod ram 1. More precisely, the two ends of the cylinder 1 are shown in longitudinal section that in the present embodiment are constructed substantially in mirror symmetry.

The hydraulic cylinder 1 has a hollow outer cylinder 10, a hollow inner cylinder 20, and on each of the left and the right a head section 30 and a piston rod 40 with a work piston 41 integrated therein or connected therewith. The head section 30 has a cylinder head support 31 and a cylinder closure 33, whereby the hydraulic cylinder 1 is closed at both ends and the inner cylinder 20 is fixed relative to the outer cylinder 10. The inner cylinder 20 is inserted into the outer cylinder 10 and the two lie concentrically relative to one another, so that an annular gap 51 that is a component of a circumventing or bypass device 50 described later in detail, is formed between the inner cylinder 20 and the outer cylinder 10. The work piston 41 is displaceably mounted in the inner cylinder 20. The piston rod 40 extends on either side of the work piston 41, penetrates the respective head sections 30 and is guided by these. Seals and parts for mounting the piston rod 40 and the work piston 41 that ensure problem-free operation of the hydraulic cylinder 1, can be provided at suitable points, these being partly illustrated in FIG. 1, but not described in more detail.

Disposed on the left and right of the work piston 41 are compartments 42 that are surrounded and thereby defined by the work piston 41, the inner cylinder 20 and components at the head side, such as, for example, the cylinder head support 31 and a bypass valve 52 which is described later. The work piston 41 is acted on from both sides by a pressure medium or hydraulic fluid, for example a hydraulic oil, present in the compartments 42. The hydraulic fluid is supplied to the compartments 42 by bores of lines, here termed hydraulic fluid lines 32. The hydraulic fluid lines 32 extend through the two head sections 30. The hydraulic fluid lines 32 can have a hydraulic fluid connection 32', a hydraulic fluid ring line 32" and other components suitable for reliably feeding hydraulic fluid under pressure to the compartments 42, distributing it and discharging it, or can be connected therewith in terms of fluid flow.

A pressure difference of the hydraulic fluid between the two compartments 42 produces a force on the work piston 41 which can lead to displacement of the work piston 41 in axial direction and thus of the piston rod 40. For that purpose, an inflow of hydraulic fluid into one of the two compartments 42 by the relevant hydraulic fluid line 32 and a displacement of the hydraulic fluid into the other compartment 42 take place, hydraulic fluid being discharged by the other hydraulic fluid line 32. Because the effective area of the work piston 41 on both sides is of the same size, the hydraulic cylinder 1 acts as a double-rod ram, also termed synchronizing cylinder. This mode of operation is termed work mode for distinction from a towed mode of operation which is described in the following and which enables a pressure-free or low-pressure displacement of the work piston 41.

For rapid, pressure-free movement of the work piston 41, for example for position or adjusting a receiver in an extruder, the hydraulic cylinder 1 has a bypass device 50. In the present example this comprises the annular gap 51, the two bypass valves 52, bypass ducts 53 that are in fluid connection with the annular gap 51, and actuators 54. The two bypass valves 52 are guided on the piston rod 40 in the region of the two head sections 30 and open and close the bypass lines 53 in that they are actuated, i.e. displaced, by the actuator 54 in axial direction. When the bypass valve 52 is open, the hydraulic fluid can pass from the hydraulic chamber 42 concerned into the adjacent bypass duct 53 and from there the hydraulic fluid passes into the annular gap 51. If both bypass valves 52 are open, the work piston 41 can in this way displace without force or with low force, since the fluid connection between the two compartments 42 exists by the bypass ducts 53 and the annular gap 51. In that case, the annular gap 51 through its external arrangement and annular shape enables, in particular, optimum behavior in terms of flow.

Actuation of the bypass valves 52 takes place by the actuators 54. In the present example these each comprise an actuating rod 54' that is biased by a spring and extends through the respective head section 30 and which is connected with the bypass valve 52, and an actuating hydraulic section 54" with an actuating connection 54'", a bore and a chamber (without reference numerals). Due to the fact that the bypass valve 52 is biased, here, by example, by the spring, the bypass valve 52 is automatically brought into a preferential position. The actuating valve 52 is actuated by a fluid being introduced into or let off from the actuating hydraulic section 54" by the actuating connection 54'".

The bypass device 50 for pressure-free or low-pressure movement of the work piston 41 is realized by the above-described annular gap 51 that runs through the concentric hollow cylinders 10 and 20 externally around the work piston 41. This technical solution is space-saving and highly satisfactory with respect to flow relationships, because the annular gap 51 has the lowest flow losses by comparison with other solutions. The annular bypass valves 52 that are here illustrated by example and which are guided on the piston rod 40 concentrically therewith, allow rapid and reliable switching over of the modes of operation of the hydraulic cylinder 1. A selective control of the transfer flow of hydraulic fluid between the two compartments 42 or from the annular gap 41 to the compartments 42 is thus realized in a technically simple manner which is non-susceptible to fault and is durable. Moreover, the technical solution illustrated here has a small number of hydraulic connections, whereby operation of the hydraulic cylinder 1 is further simplified.

Figure 2:
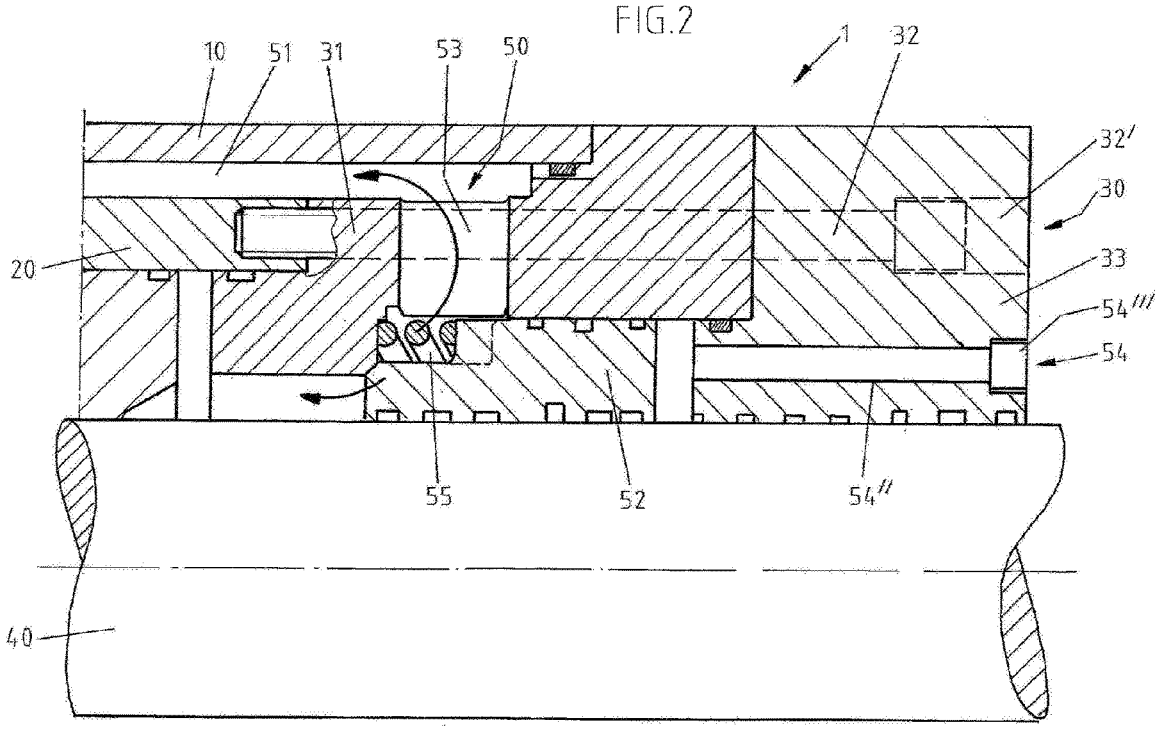
FIG. 2 shows a detail of a longitudinal section through a double-rod ram with a modified construction.

FIG. 2 shows a construction modified with respect to the actuator 54. For the purpose of illustration, there is shown merely a detail of the longitudinal section through the double-rod ram 1, but this can be of substantially mirror-symmetrical construction as in FIG. 1.

By contrast with the double-rod ram of FIG. 1, the actuator 54 for actuation of the bypass valves 52 does not have an actuating rod 54' with an externally disposed restoring spring, but restoration or biasing of the bypass valve 52 takes place by an internally disposed spring 55. The actuating hydraulic section 54" with the actuating connection 54'" is substantially unchanged. At that end of the actuating hydraulic section 54" which is opposite the actuating connection 54'" there is provided an annular chamber (without reference numeral, but readily recognizable in FIG. 2) which at one side adjoins the bypass valve 52. The actuation of the bypass valve 52 takes place like in the embodiment of FIG. 1; i.e. since the bypass valve 52 is biased, here according to FIG. 2 by the internally disposed spring 55, the bypass valve 52 is automatically brought into a default position. The actuating valve 52 is actuated by a fluid being introduced into or let out from the actuating hydraulic section 54" by the actuating connection 54'".

By virtue of the slender construction, the double-rod ram 1 can be led through a cylinder beam of an extruder. For this reason, the hydraulic cylinder 1 is usable, with particular preference, in the field of extruders, particularly for realization of receiver kinematics, inclusive of the force function. It has the great advantage that it can be converted by pressure-free adjustment over the entire stroke from towed operation to work operation. The double-rod ram 1 is thus capable of assisting, in all positions, any electric motors for rapid movement over the complete stroke with the full cylinder force.

The installation position of the double-rod ram 1 in an extruder 100 is shown in FIG. 3. The double-rod ram 1, the construction of which in FIG. 3 is shown in less detail than in the preceding figures, is guided by a cylinder beam 101. One end of the piston rod 40 is connected with a receiver 102 that is movable by the double-rod ram 1, for example, between a position for ingot change and a front end position, the work position, at which pressing against, releasing and stripping take place.

Alternatively, the receiver 102 can be moved by one or more electric motors (not illustrated) which displace the receiver 102 between the ingot change position and the work position. The double-rod ram 1 is in that case moved externally. For such an external movement, i.e. for rapid, pressure-free actuation of the double-rod ram 1, this is switched over in the above-described manner to the towed mode of operation.

FIG. 4 shows an alternative form of embodiment of the double-rod ram 1 according to the invention in which in departure from the first form of embodiment according to FIGS. 1 to 3 a bypass device 50 in the form of a bypass line 103 is outside the housing and the compartments 42 are connected together by respective bypass valves 52. The bypass line 103 replaces the annular gap between the outer cylinder 10 and inner cylinder 20 according to the forms of embodiment of FIGS. 1 to 3. However, the bypass line 103 achieves the same technical results as the annular gap 51 according to the forms of embodiment of FIGS. 1 to 3.

Figure 5A:
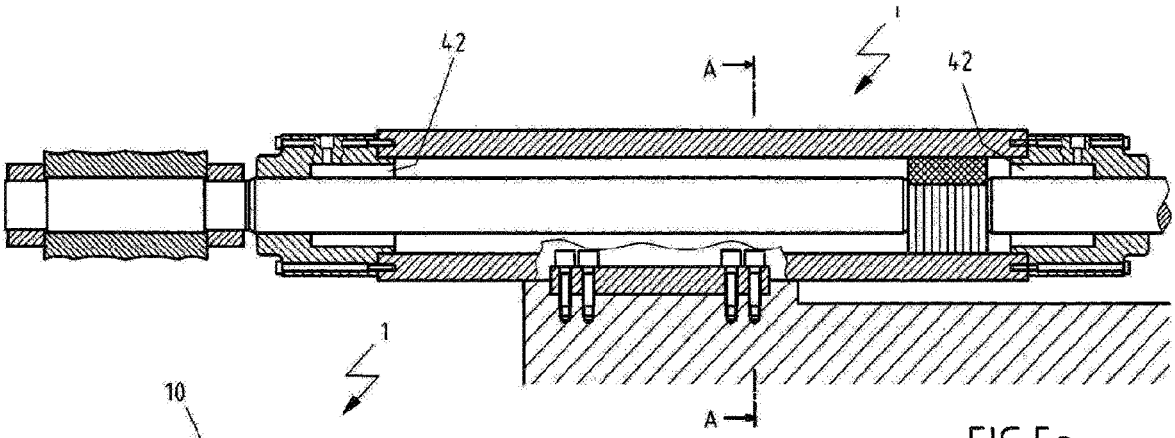
FIG. 5 shows a further form of embodiment of the invention with a plurality of bypass lines integrated in the double-rod ram.
Figure 5B:
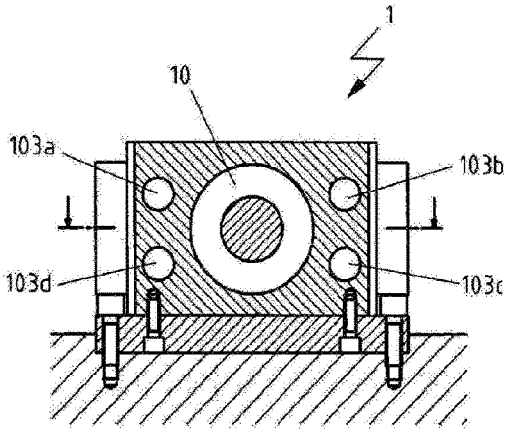

FIG. 5 shows a further form of embodiment of the double-rod ram 1 according to the invention in a side view as well as an end view sectioned along the line A-A of FIG. 5*a*. It can be seen from the end view according to FIG. 5*b* that four bypass lines 103*a-d* are arranged within the housing of the double-rod ram 1 outside the outer cylinder 10. These bypass lines 103*a-d* entirely replace, just like the bypass line 103 according to FIG. 4, the annular gap 51 according to the forms of embodiment of FIGS. 1 to 3. The bypass lines 103*a-d* connect, just like the bypass line 103 according to FIG. 4, the compartments 42 of the double-rod ram 1.

Insofar as feasible, all individual features illustrated in the embodiments can be combined with one another and/or interchanged without departing from the scope of the invention. Not all technical features illustrated in the scope of the exemplifying forms of embodiment need to be essential to the invention. Thus, for example, the inflow and outflow between the annular gap 51 and the compartments 42 can be realized in a different way than by the bypass ducts 53 illustrated here. In addition, the bypass valves 52 can be differently constructed and/or positioned, although the described technical solution is preferred.

The invention claimed is:

1. A double-rod ram for an extruder, the ram comprising:
an outer cylinder extending along an axis;
an inner cylinder installed therein and coaxial therewith;
a double-acting work piston axially displaceable in the inner cylinder and subdividing same into a pair of compartments pressurizable with a hydraulic fluid; and
two bypass valves axially flanking the work piston and movable between respective bypass positions forming a direct fluid connection between the two compartments and respective work positions in which no such fluid connection is present.

2. The double-rod ram according to claim 1, wherein the direct connection is a bypass line formed between the outer cylinder and the inner cylinder of the double-rod ram.

3. The double-rod ram according to claim 1, further comprising:
a return spring biasing the bypass valve into the bypass position or the work position.

4. The double-rod ram according to claim 3, wherein the return spring is provided partly or completely inside the outer cylinder.

5. The double-rod ram according to claim 1 wherein the bypass valve is hydraulically actuatable.

6. The double-rod ram according to claim 1, wherein the outer cylinder is closed at each of its ends by a respective cylinder closure, the inner cylinder is fixed at each of its ends relative to the outer cylinder by a respective cylinder head support, and a respective hydraulic fluid connection and hydraulic fluid line that are formed in the cylinder closure and/or cylinder head support of the corresponding side, are provided at each of the two ends.

7. The double-rod ram according to claim 6, wherein the two cylinder head supports each have one or more bypass ducts forming a fluid connection between the compartments and an annular gap between the inner and outer cylinders.

8. The double-rod ram according to claim 7, wherein the bypass valves are in contact not only with the piston rod, but also with the corresponding cylinder head support and in the work position close and in the bypass position open the fluid connection between the corresponding compartment and the corresponding bypass duct.

9. A double-rod ram for an extruder, the ram comprising:
an outer cylinder extending along an axis;
an inner cylinder inside the outer cylinder, coaxial with the outer cylinder, and forming a with the outer cylinder;
a double-acting work piston axially displaceable in the inner cylinder and subdividing same into a pair of compartments pressurizable with a hydraulic fluid;
a bypass line extending between the compartments and outside the housing; and
a bypass valve movable between a bypass position forming a direct fluid connection through the bypass line between the two compartments and a work position in which no such fluid connection is present.

10. A shaping apparatus having a double-rod ram comprising:
an outer cylinder extending along an axis;
an inner cylinder installed therein and coaxial therewith;
a double-acting work piston axially displaceable in the inner cylinder and subdividing same into a pair of compartments pressurizable with a hydraulic fluid; and
a bypass valve movable between a bypass position forming a direct fluid connection between the two compartments and a work position in which no such fluid connection is present.

11. The shaping apparatus according to claim 10, further comprising:
one or more electric motors for actuating the double-rod ram.

* * * * *